US005184667A

United States Patent [19]

Carrupt et al.

[11] Patent Number: 5,184,667

[45] Date of Patent: Feb. 9, 1993

[54] PROCESS AND INSTALLATION FOR THE ELECTROMAGNETIC CASTING OF ROLLED BARS FROM AN ALUMINUM ALLOY HAVING A RIPPLEFREE SURFACE

[75] Inventors: Bertrand Carrupt, Sierre; Maurice Constantin, Sion; Michel Ebener, Bramois, all of Switzerland

[73] Assignee: Alusuisse-Lonza Services Ltd., Zurich, Switzerland

[21] Appl. No.: 783,766

[22] Filed: Oct. 28, 1991

[30] Foreign Application Priority Data

Nov. 6, 1990 [CH] Switzerland ..... 3522/90

[51] Int. Cl.[5] ..... B22D 27/02

[52] U.S. Cl. ..... 164/467; 164/503

[58] Field of Search ..... 164/467, 503, 478, 416

[56] References Cited

U.S. PATENT DOCUMENTS 4,273,180 6/1981 Tertishnikov et al. .
4,724,896 2/1988 Rose et al. .
4,989,666 2/1991 Weber .

FOREIGN PATENT DOCUMENTS 0375620 6/1990 European Pat. Off. .
2-255246 10/1990 Japan ..... 164/467

OTHER PUBLICATIONS

Japanese Patent Publication 58202957-Nov. 26, 1983, Patent Abstracts of Japan, Band 8, No. 50.

*Primary Examiner*—Kuang Y. Lin
*Attorney, Agent, or Firm*—Bachman & LaPointe

[57] ABSTRACT

During electromagnetic continuous casting of rolled bars from aluminum/magnesium alloys defects in the form of vertical ripples and oxide deposits arise on the bar surface as a consequence of the greatly increased rate of oxidation at the melt surface due to the presence of magnesium in the melt, which defects make it necessary to mill over the rolled surfaces of the bar in the case of stringent requirements with respect to the surface quality of rolled products. The said surface defects can be prevented using an oxide barrier which dips into the melt head, extends at least over the longitudinal sides of the inductor and is arranged approximately parallel to and at a distance from said longitudinal sides, which oxide barrier is moved backwards and forwards horizonally in its longitudinal direction.

17 Claims, 1 Drawing Sheet

PROCESS AND INSTALLATION FOR THE ELECTROMAGNETIC CASTING OF ROLLED BARS FROM AN ALUMINUM ALLOY HAVING A RIPPLEFREE SURFACE

BACKGROUND OF THE INVENTION

The invention relates to a process for preventing the ripple formation and oxide deposition on the rolled surfaces of a rolled bar from an aluminum alloy, in particular an aluminum/magnesium alloy, during vertical electromagnetic continuous casting using an essentially rectangular inductor and an oxide barrier dipping into the melt head. An installation for carrying out the process also lies within the scope of the invention.

During electromagnetic casting of rolled bars from aluminum/magnesium alloys containing more than about 3% by weight of magnesium defects in the form of vertical ripples and oxide deposits arise on the bar surface, which defects make it necessary to mill over the rolled surfaces of the bars in the case of stringent requirements with respect to the surface quality of rolled products. The cause of the ripple formation and oxide deposits is the high rate of oxidation caused by magnesium at the surface of the aluminum/magnesium alloy melt.

It is known drastically to lower the rate of oxidation by adding beryllium to the metal melt and thus to suppress the surface defects mentioned. However, the addition of beryllium to aluminum alloys is already prohibited in the U.S.A. and a similar ban is also to be expected in other countries in the near future.

U.S. Pat. No. 4,724,896 discloses an installation for reducing the said surface defects in the case of electromagnetic casting of rolled bars by installing an oxide barrier, which is known per se and dips into the melt head and is also known by the technical term of skim dam. The outer edges of the oxide barrier form an angle of between 105 and 150 with the metal melt, as a result of which the radius of the meniscus of the surface of the metal melt is substantially reduced in the zone in contact with the outer edges of the oxide barrier. It is alleged that as a result of this the oxide skin forming on the melt surface breaks away in brief intervals, before the oxide layer has reached the critical thickness for ripple formation and oxide deposition. However, it has been found that even with sloping outer edges of the oxide barrier the surface defects cannot be completely eliminated.

SUMMARY OF THE INVENTION

In the light of these facts it was the aim of the inventor to provide a process and a suitable installation of the initially mentioned type, with which the ripple formation and oxide deposition on the surface of rolled bars of aluminum alloys produced by electromagnetic casting can be prevented.

With regard to the process, the object is achieved according to the invention in that the oxide barrier, which extends at least over the longitudinal sides of the inductor and is arranged approximately parallel to and at a distance from said longitudinal sides, is moved backwards and forwards horizontally in its longitudinal direction.

In principle, in the case of a rectangular inductor for casting rolled bars the oxide barrier can consist merely of two parts adjacent to the longitudinal sides of the inductor and can be lacking towards the transverse sides of the inductor. In practice, however, it is expedient to use a frame-shaped oxide barrier. As a result of the continual motion of the oxide barrier, ripple formation and oxide deposition on the rolled surfaces of the bars is prevented by early tearing and loosening of the oxide skin forming on the melt surface.

One movement cycle should appropriately last 1 to 8 sec, preferably about 3 sec, the horizontal displacement of the oxide barrier between two end positions being 5 to 15 mm, preferably about 8 mm.

The said early loosening of the oxide skin on the melt surface can be promoted by initiating vibrations in the oxide barrier in the direction in which the billet is withdrawn. The suitable vibration frequency is between 50 and 1000 Hz, preferably about 400 to 600 Hz.

The optimum acceleration value of the vibratory movement is between +/−20 g and +/−60 g, denoting the acceleration due to gravity.

The combination of horizontal movement of the oxide barrier with vertical initiation of vibrations already proves to be advantageous before the actual start of casting during the metal feed stage since, by this means, on the one hand the uniform passage of the metal melt is facilitated when using a metal distributor bag made of heat-resistant fabric and, on the other hand, the optimum mold filling of the starting base, which is required for good bar quality, is achieved.

The appropriate depth of immersion of the oxide barrier in the metal melt is 5 to 15 mm, preferably about 10 mm.

With regard to the installation, the object is achieved according to the invention in that, with an essentially rectangular inductor and an essentially rectangular oxide barrier, the latter is fixed to a support frame which at one end is coupled to a pneumatic cylinder in fixed position in relation to the inductor and at the other end is guided in a guide in fixed position in relation to the inductor.

In order to initiate vertical vibrations, at least one vibrator, preferably a ball vibrator, is fixed to the support frame.

The distance between the longitudinal sides of the inductor, which are essentially parallel to one another, and the oxide barrier is appropriately between 50 and 100 mm and is preferably about 70 to 80 mm.

BRIEF DESCRIPTION OF THE DRAWINGS

Further advantages, features and details of the invention can be seen from the following description of an illustrative embodiment and with reference to the drawing; the latter shows in FIG. 1 the diagrammatic cross-section through a continuous casting unit.

DETAILED DESCRIPTION

Figure 1:
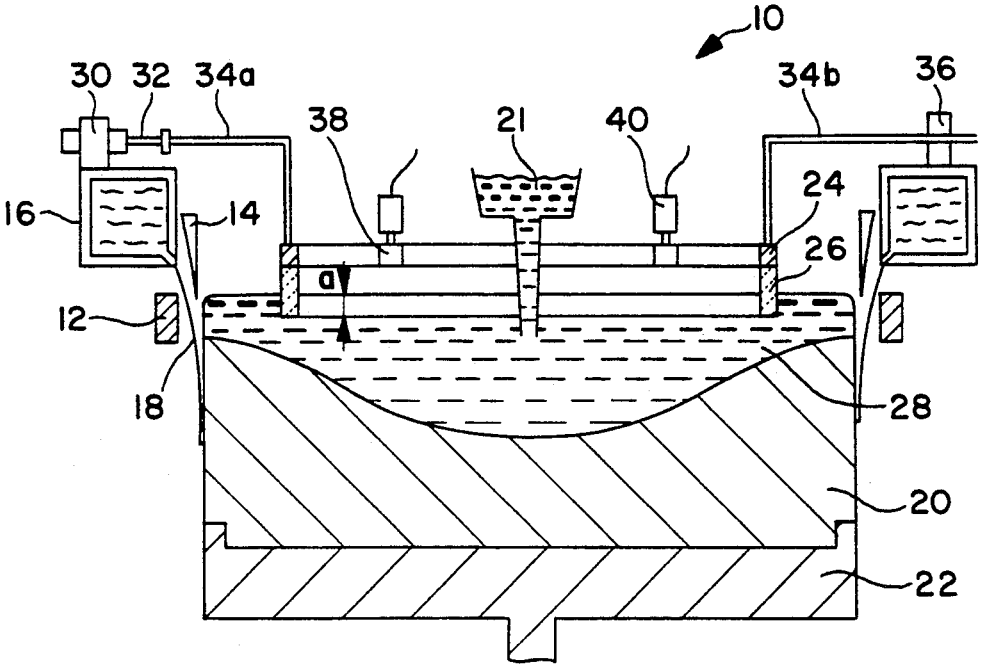

According to FIG. 1, a vertical electromagnetic continuous casting unit 10 has, as mold, a loop-type inductor 12, which is partially covered by a screen 14 for fine adjustment of the electromagnetic field. An annularly arranged coolant box 16 serves to supply coolant 18 to the surface of the billet or rolled bar 20 issuing from the mold. The liquid metal is fed to the mold via a casting die 21. The billet 20 is continually lowered by means of a starting base 22, which keeps the mold closed until the start of casting.

An oxide barrier 26, which is made of a ceramic material and is essentially matched to the loop shape of the inductor 12, is fixed to a steel support frame 24 and dips over a dimension "a" of, for example, 10 mm into the melt head 28 of the billet 20. A pneumatic cylinder 30, the piston rod 32 of which is connected to a first suspension 34*a* of the support frame 24, is mounted on the coolant box 16. A second suspension 34*b*, which is opposite the first suspension 34*a*, of the support frame 24 is supported in a guide 36 mounted on that side of the coolant box 16 which is diametrically opposite to the pneumatic cylinder 30.

Figure 2:
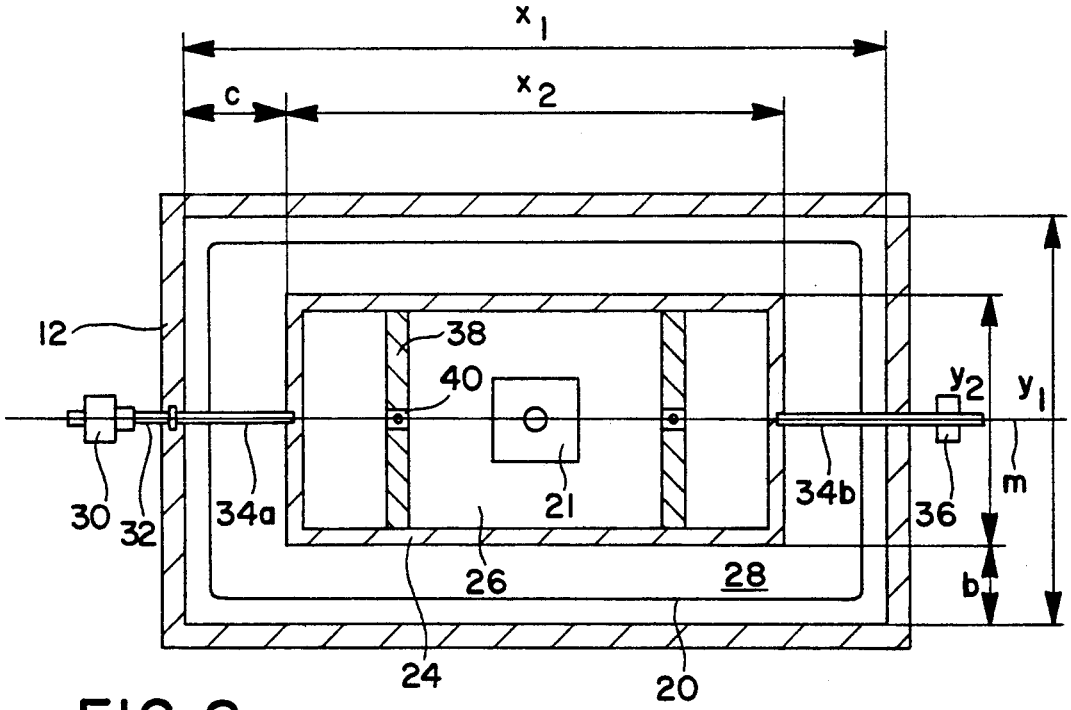
FIG. 2 the diagrammatic plan view of an inductor with oxide barrier.

FIG. 2 shows the arrangement of the support frame 24 and the oxide barrier 26 with reference to the position of the inductor 12 for a billet 20 in the form of a rectangular rolled bar having bar dimensions of about 1600 ×660 mm, corresponding to a length $x_1 = 1600$ mm for the longitudinal side and $y_1 = 660$ mm for the transverse side of the inductor 12. The longitudinal and transverse sides of the oxide barrier 26, which is likewise rectangular, are symmetrical and parallel to the corresponding inductor sides and have a length of, for example, $x_2 = 1420$ mm and $y_2 = 500$ mm. The distance b between the longitudinal sides $x_1$ and $x_2$ of the inductor 12 and the oxide barrier 26 respectively is thus 80 mm and the distance c between the transverse sides $y_1$ and $y_2$ 90 mm.

The support frame 24 with the oxide barrier 26 can be moved backwards and forwards horizontally in the direction of the longitudinal sides $x_1$ of the inductor 12 via the piston rod 32 of the pneumatic cylinder 30, which piston rod 32 is guided horizontally and in the midplane m parallel to the rolled surface of the billet 20. Ball vibrators 40 are fixed to transverse struts 38 of the support frame 24.

We claim:

1. Process for preventing the ripple formation and oxide deposition on the rolled surfaces of a rolled bar from an aluminum alloy during vertical electromagnetic continuous casting, which comprises: providing an essentially rectangular inductor and an oxide barrier dipping into an aluminum alloy melt head; extending the oxide barrier at least over longitudinal sides of the inductor; arranging the oxide barrier approximately parallel to and at a distance from said longitudinal sides; and moving the oxide barrier backwards and forwards horizontally in the longitudinal direction of the oxide barrier.

2. Process according to claim 1 including the step of casting an aluminum-magnesium alloy.

3. Process according to claim 1 including the step of moving the oxide barrier in a movement cycle which takes place within 1 to 8 seconds.

4. Process according to claim 3 wherein said movement cycle is about 3 seconds.

5. Process according to claim 1 including the step of horizontally displacing the oxide barrier between two end positions, wherein said horizontal displacement is 5 to 15 mm.

6. Process according to claim 5 wherein said horizontal displacement is about 8 mm.

7. Process according to claim 1 including the step of vibrating the oxide barrier in the vertical direction.

8. Process according to claim 7 including the step of using a vibration frequency of 50 to 1000 Hz.

9. Process according to claim 8 wherein the vibration frequency is 400 to 600 Hz.

10. Process according to claim 8 including step of accelerating the vibratory movement between +/−20 g and +/−60 g.

11. Process according to claim 1 including the step of dipping the oxide barrier into the melt head at a depth of 5 to 15 mm.

12. Process according to claim 11 wherein said depth is about 10 mm.

13. Installation for preventing the ripple formation and oxide deposition on the rolled surfaces of a rolled bar from an aluminum alloy during vertical electromagnetic continuous casting, which comprises: an essentially rectangular inductor; an essentially rectangular oxide barrier adapted to dip into a metal head of an aluminum alloy melt; a support frame wherein the oxide barrier is fixed to the support frame, said support frame having one end coupled to a pneumatic cylinder in fixed position in relation to the inductor and the other end guided in a guide in fixed position in relation to the inductor.

14. Installation according to claim 13 including at least one vibrator fixed to the support frame.

15. Installation according to claim 14 wherein the vibrator is a ball vibrator.

16. Installation according to claim 13 wherein the inductor includes longitudinal sides which are essentially parallel to one another, and wherein the distance between said longitudinal sides and the oxide barrier is between 50 and 100 mm.

17. Installation according to claim 16 wherein said distance is between 70 and 80 mm.

* * * * *